United States Patent [19]

Gearin

[11] 4,060,298

[45] Nov. 29, 1977

[54] HERMAPHRODITIC CONNECTOR ASSEMBLY

[75] Inventor: John M. Gearin, Brookfield, Conn.

[73] Assignee: Bunker Ramo Corporation, Oak Brook, Ill.

[21] Appl. No.: 675,666

[22] Filed: Apr. 12, 1976

Related U.S. Application Data

[63] Continuation of Ser. No. 531,912, Dec. 12, 1974, abandoned.

[51] Int. Cl.[2] ..... H01R 25/10

[52] U.S. Cl. ..... 339/48; 285/DIG. 14

[58] Field of Search ..... 339/47 R, 47 C, 48, 339/49 R, 49 B, 89 R, 89 C, 90 R, 89 M, 90 C, 199; 285/DIG. 14

[56] References Cited

U.S. PATENT DOCUMENTS

| | | | |
|---|---|---|---|
| 1,054,812 | 3/1913 | Zierath | 285/DIG. 14 |
| 2,521,822 | 9/1950 | Boswell | 339/49 R |
| 2,739,290 | 3/1956 | Child et al. | 339/49 R |
| 2,778,995 | 1/1957 | Gross et al. | 339/48 |
| 3,154,359 | 10/1964 | Farber | 339/199 C |
| 3,398,388 | 8/1968 | Chow | 339/49 B |
| 3,601,764 | 8/1971 | Cameron | 339/89 M |
| 3,623,753 | 11/1971 | Henry | 285/DIG. 14 |
| 3,680,034 | 7/1972 | Chow et al. | 339/48 |

*Primary Examiner*—Roy Lake
*Assistant Examiner*—Howard N. Goldberg
*Attorney, Agent, or Firm*—William Lohff; F. M. Arbuckle

[57] ABSTRACT

The following specification describes a hermophroditic RF connector assembly used on an airline and employing a spring biased registration ring having axially extending teeth with cam surfaces for engagement between teeth on a mating registration ring of another airline connector assembly in response to relative rotation between the rings to align the mating contact surfaces of two mating airlines. A coupling nut on one connector assembly is threaded over the registration ring of the other connector assembly to secure the assemblies and airlines to each other and the coupling nut of one assembly may also be partially threaded over the registration ring of the respective assembly and then used to retract the respective ring against the spring bias to provide facile means to the contact surfaces. A retaining nut on each assembly frictionally engaged with the respective connector body of the assembly enables the coupling nut to be threaded without requiring a special effort to hold the connector body from becoming loose.

7 Claims, 4 Drawing Figures

HERMAPHRODITIC CONNECTOR ASSEMBLY

This is a continuation, application of application Ser. No. 531,912, filed Dec. 12, 1974, now abandoned.

BACKGROUND OF THE INVENTION

1. Field of the Invention

This invention relates in general to hermaphroditic connections and more particularly to an improved hermaphroditic connector assembly for use with an airline.

2. Summary of the Prior Art

Hermaphroditic connectors or connector assemblies employ two identically sized and shaped connectors, each secured to a respective RF or high frequency cable or airline usually by means of a respective connector body threaded onto the respective airline. The connectors are mated or joined to each other by means of a coupling nut on either connector threaded onto a registration ring of the other connector to connect outer conductors and inner conductors of each cable or airline.

The outer conductors are connected along a radial plane and the inner central conductors each have a spring biased contact arranged to engage along the same plane. In such connectors, it is important to ensure proper axial alignment of the semi-rigid or non-rotatable airlines including the conductors and contacts so that their connecting end faces meet axially along the desired plane and to protect the end faces of each conductor or contact, while providing facile access thereto for such purposes as cleaning, for example.

It is also desirable to provide an effective reaction means to avoid making a special effort for holding the connector or connector assembly against loosening when the coupling nut is threaded relative the ring of the adjacent or mating connector assembly.

SUMMARY OF THE INVENTION

The present invention proposes several improvements in hermaphroditic connectors. Thus, the registration on rings are each provided with axially extending teeth of substantial radial thickness and each ring is keyed to the connector body for limited rotation. Cam surfaces provided on the teeth enable the mating or engaging rings to automatically rotate for aligning the teeth with recesses on the opposing rings so that the rings occupy coincident axial positions and position the connecting end faces of the inner and outer conductor axially for engagement along a common radial plane. The limited rotation avoids excessive wear of the parts.

A retaining ring or nut threaded onto the connector body frictionally engages a shoulder or the connector body and also engages a C ring fixed to the respective spring biased registration ring so that rotational forces transmitted from a coupling nut as it is threaded over the registration ring are prevented from loosening the connector body from the respective airline. This removes the necessity for manually holding the body against rotation during assembly or disassembly of the connectors from each other.

The registration ring normally is spring biased to a position in front of the mating faces and protects the same from damage, however, by threading the respective coupling nut partially over the associated ring and then simply retracting the ring against the spring bias, facile access to the mating faces for cleaning is provided.

It is therefore a primary object of the present invention to provide an improved hermaphroditic connector assembly.

Other objects and features of the present invention will become apparent upon examination of the following specification and claims together with the drawings.

DESCRIPTION OF THE INVENTION

Figure 1:
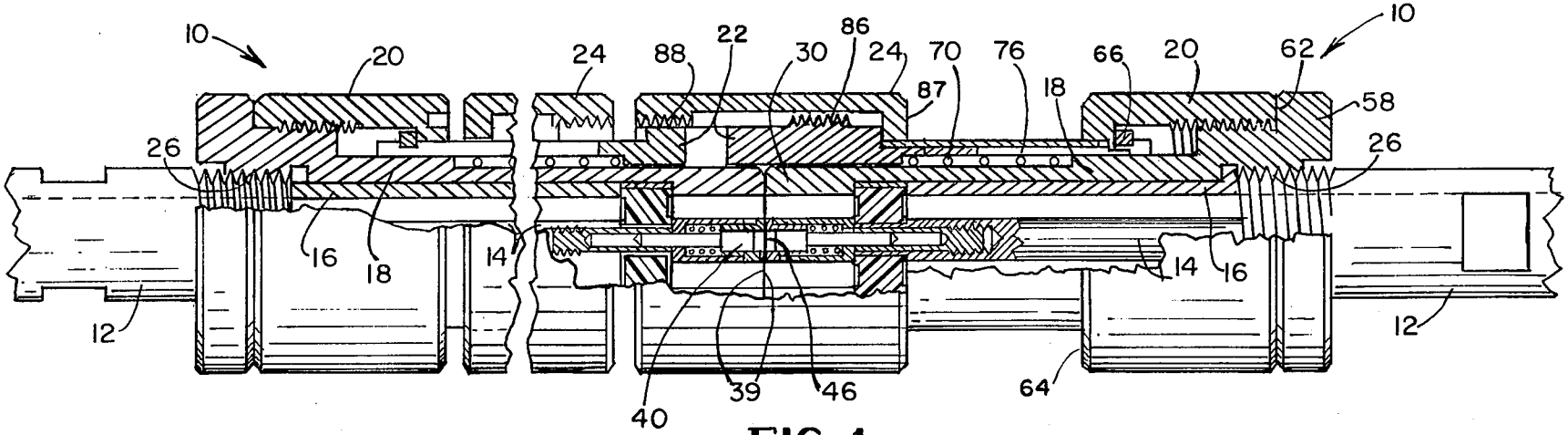
FIG. 1 is a view partially in section illustrating an arrangement of a pair of mating hermaphroditic connectors employing the principles of the present invention.

In FIG. 1, a hermaphroditic connector assembly arrangement including a pair of hermaphroditic connectors or connector assemblies is each indicated by the reference character 10. Each assembly 10 is arranged on a respective coaxial cable or airline 12 for electrically connecting an inner conductor 14 best seen in FIG. 4 and an outer conductor 16 of one cable or line 12 with the inner conductor 14 and the outer conductor 16 respectively of the other cable or line 12.

Each connector assembly 10 includes an elongate tubular or annular connector body 18, a retaining ring or nut 20, a tubular or annular registration ring 22 and coupling nut 24.

The body 18 is provided adjacent the rear end thereof with internal threads 26 for threaded engagement with threads formed on the outer surface of the conductor 10 of the respective line 12 and spaced from the front end 28 of the conductor 16. The elongate body 18 extends axially forwardly from the threads 26 for overlapping engagement with the outer surface of conductor 16. A radially inwardly extending annular portion 30 is provided at the front end of body 18 to define a radially inwardly extending shoulder spaced from the forward or front end 28 of conductor 16 and abutting a ring assembly 32.

The ring assembly 32 is sandwiched between the shoulder on portion 30 and the front end 28 of conductor 16 and it includes a conventional plastic or dielectric ring 34 fixed on the periphery of inner conductor 14 with a metal ring 36 on the outer periphery of ring 34 and engaging both conductor 16 and body 18. Electrical compensation means 38 are provided on the ring 34. The conductor 16 thus includes or is provided with a radial end face 39 on the front end of portion 30 for engagement with a similar radial face on the body radial end portion 30 of the mating connector to extend an electrical connection between the outer conductors 16.

A center contact assembly 40 is secured to the front end of conductor 14 and the contact assembly 40 includes a central cylindrical retainer 42 carrying a central sleeve or tubular contact 44 with a forward radial face 46. Radial face 46 is thus connected to the inner conductor and engages a forward radial face of the central contact of the opposing or mating center contact assembly associated with the inner conductor in the other airline 12 to electrically connect the inner conductors 14. The center contact faces 46 desirably meet along a radial plane concentric and coplanar with the plane of face 39 to ensure that both conductors are properly connected.

A rearwardly extending reduced diameter shank 48 on retainer 42 forms a shoulder on retainer 42 and shank 48 passes through a rear reduced diameter portion of contact 44 and through a tubular portion on the end of a second retaining member 50. The shank portion 48 is press fit in a central opening of member 50 and a rearwardly extending shank portion 52 of the member 50 is threaded in the end of conductor 14 to secure the contact assembly 40 thereto.

A spring 54 is located between the reduced diameter portion of contact 44 and a shoulder formed on the shank portion of member 50 for biasing the central contact 44 axially in a forward direction with the movement of the central contact limited by the enlarged diameter portion of retainer 42 engaging the forward shoulder formed by the reduced diameter portion of contact 44.

A radially outwardly extending portion 58 is provided adjacent the rear end of the connector body 18 axially adjacent threads 26. The portion 58 has reduced diameter section on which external threads 60 are formed with the reduced diameter portion or section of portion 58 terminating in a radially outwardly extending shoulder 62 for abutting engagement with the rear axial end of retaining nut 20 in response to the threaded in engagement of the nut 20 with threads 60. The abutting engagement of nut 20 with shoulder 62 provides a frictional retaining force for preventing unthreading of body 18 from the registration ring 22. The remainder of the outer periphery of portion 58 is knurled and/or formed for engagement with an appropriate wrench to thread the body 18 onto the airline 18.

Nut 20 extends forwardly of threads 60 and has a radially inwardly extending lip or shoulder 64 adjacent the forward end thereto and overlaps a C ring 66. The C ring 66 is held in an annular groove formed adjacent the rear end of a rearwardly extending annular portion 68 of the registration ring 22 and the front radial surface of the C ring is normally engaged by the rear surface of the lip 64 to limit the axial forward movement of the registration ring 22.

The annular portion 68 of registration ring 22 overlaps a reduced outer diameter portion of body 18 and a coil spring 70 is located between a radially outwardly extending shoulder 72 on body 18 and a radially inwardly directed shoulder 74 of the registration ring 22. The spring 70 serves to bias the ring 22 in an axially forward direction so that C ring 66 will engage lip 64. The annular portion 68 is provided with a keyway 76 extending from its rear end for receiving a short key 78 formed rearwardly of shoulder 72. A thin axially slotted sleeve 80 included in the connector assembly 10 overlaps the annular portion 68 and the keyway 76 forwardly of the C ring 66 with the stop or lip 64 being circumferentially clear of the sleeve 80. The key 78 extends circumferentially and axially for a shorter distance than the keyway 76 to permit only limited relative rotation between body 18 and the registration ring 22 together with axial movement of the registration ring 22 between lip 64 and the front end of the reduced diameter section of portion on body 18 so that wear is minimized.

The registration ring 22 has a forwardly extending annular portion 82 defining four axially extending equi-circumferentially spaced teeth 84 with an internal diameter corresponding to the external diameter of the adjacent axial portion of body 18 for axial and rotational movement thereon. It will be noted that under the bias of spring 70 the teeth 84 extend substantially forward of the radial faces 39 and 46 to protect the same. The external periphery of the teeth 84 have threads 86 spaced from opposite axial ends of teeth 84 and portion 82 for engagement with threads 88 on the internal periphery and adjacent the front end of the coupling nut 24.

The threads 88 on coupling nut 24 extend only a short distance from the front end of nut 24 so that threads 88 may disengage from the registration ring threads 86 whenever the nut 24 is threaded past threads 86 in opposite axial directions. A radially inwardly extending stop shoulder or lip 87 formed at the rear axial end of nut 24 engages the rear axial end of portion 82 to limit the forward movement of the coupling nut 24, or if the nut is moved in the opposite or rear axial direction, the rear end of nut 24 abuts the front end of the retaining nut 20 to limit movement in the rearward direction.

Figure 2:
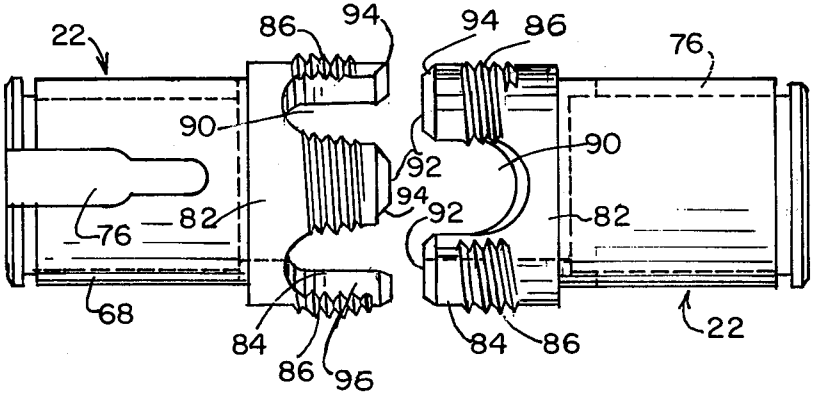
FIG. 2 is an elevational view of the registration rings in axial alignment.
Figure 3:
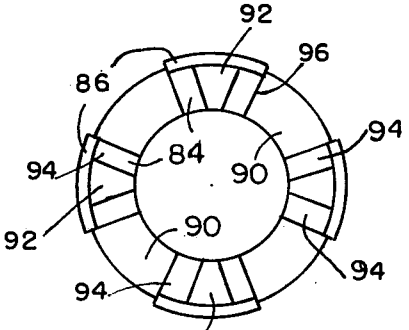
FIG. 3 is a front elevational view of one of the registration rings.

The teeth 84 of registration ring 22 are equi-circumferentially spaced at substantially 90° to each and define axially extending slots 90 as best seen in FIGS. 2 and 3 for receiving the teeth 84 of the mating ring. The axially extending teeth 84 on one registration ring 22 are thus received or engaged in the slots 90 of the registration ring 22 of the mating connector assembly 10.

Each tooth 84 is defined by a front radially inwardly extending wall 92 having a cam surface or side wall 94 at opposite radial edges of the front wall 92 extending rearwardly at an angle of substantially 30° to join a respective axially rearwardly extending side radial wall 96 of the respective tooth. The beveled or angled side walls 94 serve as camming or cam surfaces to rotatably cam the teeth of the registration rings 22 for aligning the same with a respective slot 90 of the opposite registration ring in response to axial movement of the rings toward each other. The circumferential relationship between the key 78 and the keyway 76 of each registration ring permits each ring to rotate substantially one half the distance between the teeth so that the teeth may align with the slots and with the chosen 30° angle each registration ring is permitted by key 78 and keyway 76 to rotate through 60°.

The connector assemblies 10 are assembled by inserting the forward portion of body 18 into rear portion 68 of the registration ring 22 with the spring 70 positioned between the shoulders 72 and 74 until the key 78 engages in the keyway 76. Sleeve 80 is placed in position over spring 70. Coupling nut 24 is assembled in position just prior to assembly of coupling nut 20. The C ring 66 is then assembled to ring 22 for holding the nuts on the ring 22 and the nut 20 is then threaded on portion 58 of body 18 to hold the ring 22 and the nuts 20 and 24 on the body 18.

To assemble the connector assembly 10 to the airline 12, which is generally semi-fixed or has limited rotational facility, the threads 26 on body 18 are threaded onto the airline. The retaining nut 20, of course, is threaded onto the threads 60 until the rear end of nut 20 tightly abuts the shoulder 62 on the body 18. Notches such as 98 in the periphery of the nut 20 permit a tool to be used for tightening the nut under considerable torque against the shoulder 62. The bias of spring 70 holds the C ring 66 against lip 64 with the teeth 84 extending axially forward of the faces 39 and 46.

To mate or engage the connector assemblies 10 on adjacent airlines 12, the registration rings 22 are placed in generally axially aligned and adjacent positions relative to each other with the teeth 84 projecting in opposite directions toward the other ring. Relative axial movement of rings 22 toward each other causes the cam surface 94 on the teeth to rotate the opposite teeth 84 and align the teeth with the slots 90 if not already so aligned. The teeth thus move forwardly to overlap the registration ring 22 of the mating or engaging connector assembly located on the other airline 12. This ensures that the radial faces 39 and 46 are each axially aligned on the same plane and not cocked at an angle to each other since the wall thickness of the teeth are substantial and ensures the axial alignment of the airlines. Since the keys 78 permit only sufficient rotation to enable the teeth to move past each other, the rings are now locked against rotation relative the bodies 18. Unnecessary wear is thus avoided.

Figure 4:
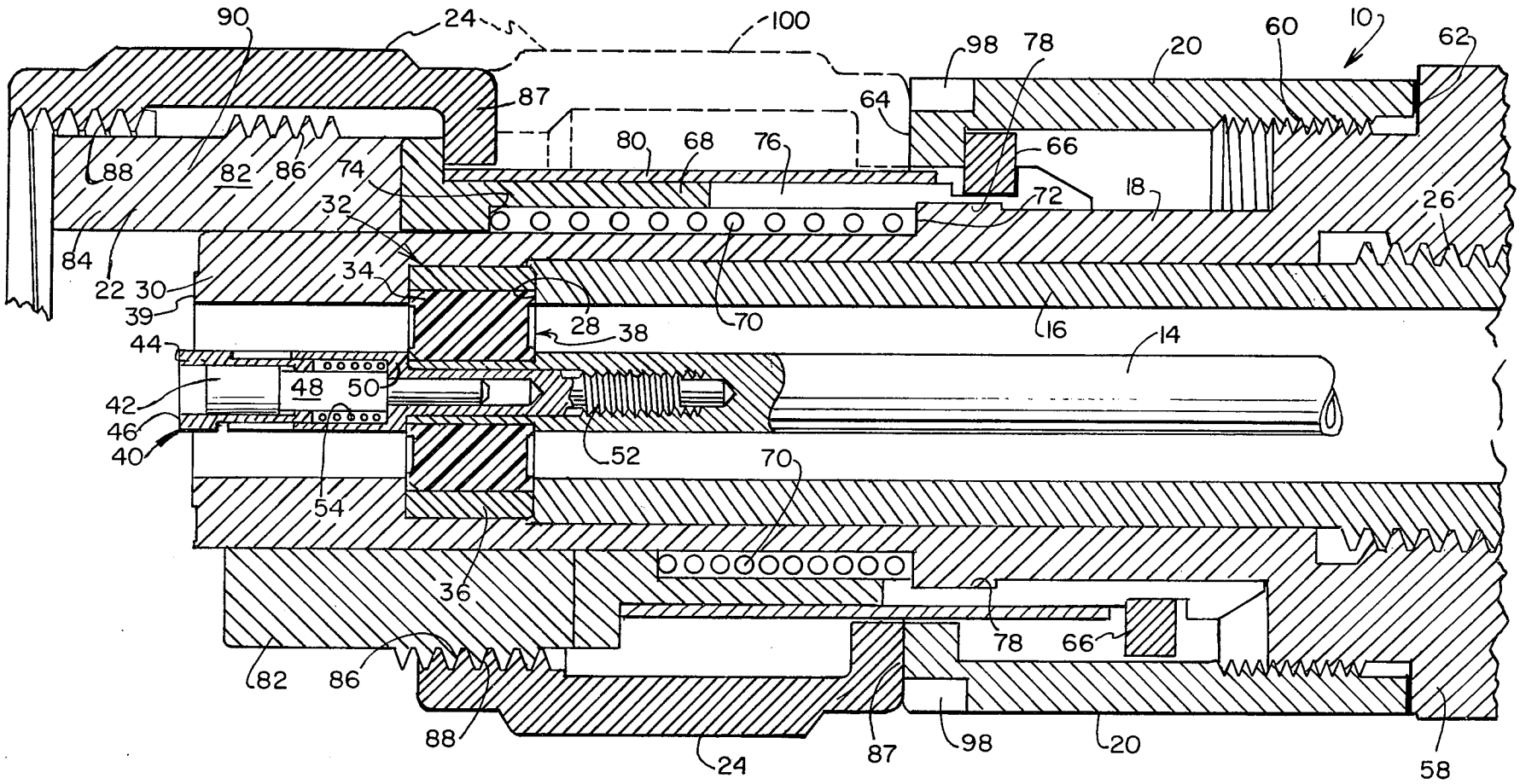
FIG. 4 is a sectional view illustrating one of the hermaphroditic connector assemblies with the registration ring and coupling nut in advanced and retracted positions respectively.

Then, one coupling nut 24 on either connector is moved, for example, from the position indicated by dotted lines 100 in FIG. 4 and threaded over the threads 86 of its associated registration ring 22 and past that ring onto the threads 86 of the registration ring 22 associated with the adjacent mating connector assembly 10. The center contact 44 of each airline being spring biased engages the center contact 44 of the opposite airline to complete the connection for the inner conductors 14, while the faces indicated by 39 engage under axial pressure to complete the connection for the outer conductors 16.

As the nut 24 is tightened on the registration ring of the mating connector, the lip 87 on the nut 24 exerts axial pressure on the registration ring of its assembly to in turn place the lip 64 under axial pressure of the C ring 66. Any tendency of the body 18 to move forward in response to the turning torque extended through teeth 84 is thus resisted by the rear face of retaining nut 20 bearing against shoulder 62 since the body 18 cannot move forward against the rear face of nut 20. On the mating connector, the registration ring 22 is also under axial forward pressure as the nut 24 is threaded thereon and the C ring 66 thereon places the lip 64 of associated retaining nut 20 under pressure to also resist rotation of the associated body 18. Subsequent unthreading of coupling nut 24 for disassembly from the mating connector therefore is permitted without loosening the body 18 or the mating connector. Thus no special effort need be made to hold body 18 from rotating relative the respective airline 12 so that both of the operators are available to rotate the coupling nut 24. Likewise in loosening the coupling nut 24, no special effort need be made to hold the body 18 of the mating connector from rotating relative the associated airline 12 since the C ring on that connector retains the pressure on lip 64 of the associated retaining nut 20 for resisting rotation of the body 18 until the nut 24 is loose.

When it is desired to disassemble the connector assemblies from each other to permit cleaning of the center contact, for example, the engaged coupling nut 24 is simply threaded in the disengaging direction and after disengagement from the ring 22 of the mating connector assembly, continued rearward axial movement permits the threads of the coupling nut 24 to be engaged with the threads of the respective registration ring 22.

The respective registration ring 22 is now easily retracted in a rearward direction against the bias of spring 70 by simply moving the coupling nut 24 axially rearwardly without additional threading action to move the registration ring 22 to the position shown in the lower half of FIG. 4. The front end of the registration ring 22 is now directly to the rear of the front of body 18 and to the rear of faces 39 and 46, which are therefore accessible for cleaning. When the rearward axial pressure is released, the ring 22 moves forwardly of contact 44 to the position seen in the upper half of FIG. 4, under the bias of spring 70 to overlap and protect the faces 39 and 46 against inadvertent engagement with a foreign object.

The foregoing constitutes a description of an improved hermaphroditic connector arrangement and connector assembly.

What is claimed is:

1. A hermaphroditic connector assembly arrangement for use with a pair of airlines each having an outer conductor including an end face and an inner conductor including a spring biased contact having an end face with each end face adapted to engage a respective other end face along a common radial plane to complete an electrical connection between the outer conductors and another electrical connection between the inner conductors comprising:

a tubular body for each airline with each body having a front end forming the end face for the respective outer conductor adjacent the respective spring biased contact end face and means for securing the respective body to the respective outer conductor, a registration ring carried on each body for axial movement on the respective tubular body and having a plurality of spaced teeth projecting axially in one direction, means for biasing said ring in said one direction for positioning the teeth of each ring in overlapping engagement with the tubular body secured to the outer conductor of the other airline to align each end face in said common plane means on each body and ring for enabling rotation of each ring on the respective body to a predetermined position for circumferentially aligning the teeth on each ring with the spaces on the other ring for enabling the positioning of the teeth on each ring in overlapping engagement with the tubular body secured to the outer conductor of the other airline and for axially aligning all of said end faces with each ring thereafter held against rotation relative each body and a coupling nut having means engaging one ring and threadingly engaging the other of said rings in response to rotation in one direction for moving said rings axially towards each other and for securing said airlines to each other.

2. In the arrangement claimed in claim 1, a cam surface on each tooth for automatically rotating one ring relative the other ring in response to the axial engagement of a cam surface on one tooth with a tooth on the other ring to align the teeth on said one ring angularly with the space between the teeth on the other ring.

3. The arrangement claimed in claim 2 in which said teeth have a circumferential dimension corresponding to said spaces and said means for enabling rotation to a predetermined position comprises a key for each body engaging in a keyway for each ring sized for enabling each ring to rotate through a distance corresponding to one half the circumferential dimension of each tooth.

4. The assembly claimed in claim 1 in which said coupling nut is operable to retract the teeth one ring from a position overlapping the end faces of the respective body to another position to the rear of the end face of the respective body and against the bias of said biasing means.

5. The arrangement claimed in claim 1, wherein said connector assembly arrangement includes means threaded on each body for holding the respective body against movement in a direction toward the respective end face of the respective outer conductor to prevent loosening of such from the respective outer conductor.

6. The arrangement claimed in claim 5, in which said means threaded on each body for holding the respective body includes a retaining nut having a lip and each ring has means engaging said lip under axial pressure in response to the threading rotation of said coupling nut for securing said bodies to each other.

7. In a hermaphroditic connector assembly arrangement for use with a pair of airlines each having an outer conductor with an end face and an inner conductor with an end face with the end faces of one outer conductor engaging the end face of the other outer conductor and the end face of one inner conductor engaging the end face of the other inner conductor to complete an electrical connection between the outer conductors and another electrical connection between the inner conductors comprising:

a tubular body for each airline with each body having a front end and means for threading each body to the respective outer conductor, a registration ring carried on each body for axial and rotational movement relative the respective said body and having a plurality of threaded teeth projecting axially in one direction past the front end of said body and overlapping the respective end faces whereby engagement of and alignment with the threaded teeth of one ring between the threaded teeth of the ring on the other body and in overlapping engagement with the other tubular body aligns each end face in a common plane and enables a rotational torque to be transmitted between said rings, means keying each ring to each body and for preventing rotation of each ring relative the respective body in response to the engagement of the teeth of one ring between the teeth of the ring on the other body, rotatable means engaging each of said rings to secure said rings and bodies to each other ring and body and rotatable for disengaging said rings, and means secured to each body for holding the respective body against rotation relative the respective outer conductor in a direction for loosening the respective conductor.

* * * * *